US006294512B1

(12) United States Patent
Mort, III et al.

(10) Patent No.: US 6,294,512 B1
(45) Date of Patent: Sep. 25, 2001

(54) GRANULAR COMPOSITIONS HAVING IMPROVED DISSOLUTION

(75) Inventors: Paul R Mort, III; Kevin Todd Norwood, both of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/582,748

(22) PCT Filed: Jan. 13, 1998

(86) PCT No.: PCT/US98/00567

§ 371 Date: Jun. 30, 2000

§ 102(e) Date: Jun. 30, 2000

(87) PCT Pub. No.: WO99/36503

PCT Pub. Date: Jul. 22, 1999

(51) Int. Cl.[7] ..... C11D 17/06; D06L 1/12

(52) U.S. Cl. ..... 510/438; 510/276; 510/443; 510/444; 510/452; 8/137

(58) Field of Search ..... 510/276, 438, 510/443, 444, 509, 452; 8/137

(56) References Cited

U.S. PATENT DOCUMENTS

| | | | | |
|---|---|---|---|---|
| 5,080,848 | | 1/1992 | Strauss et al. | 264/117 |
| 5,152,932 | | 10/1992 | Mueller et al. | 252/550 |
| 5,366,652 | | 11/1994 | Capeci et al. | 252/89.1 |
| 5,431,857 | | 7/1995 | Capeci | 252/549 |
| 5,494,599 | | 2/1996 | Goovaerts | 252/89.1 |
| 5,569,645 | * | 10/1996 | Dinniwell et al. | 510/276 |
| 5,807,817 | * | 9/1998 | Mazzola et al. | 510/349 |
| 6,069,124 | * | 5/2000 | Appel et al. | 50/438 |

FOREIGN PATENT DOCUMENTS

| | | | | |
|---|---|---|---|---|
| 0 220 024 A2 | | 4/1987 | (EP) | C11D/1/37 |
| 0 643 130 A1 | | 3/1995 | (EP) | C11D/17/06 |
| 2 116 200 A | | 9/1983 | (GB) | C11D/1/00 |
| 2 289 687 A | | 4/1995 | (GB) | C11D/3/04 |
| 93/20172 | * | 10/1993 | (WO) . | |
| 94/01521 | * | 1/1994 | (WO) . | |
| 96/37599 | * | 11/1996 | (WO) . | |

* cited by examiner

*Primary Examiner*—Lorna M. Douyon
(74) *Attorney, Agent, or Firm*—Marianne Dressman; Kim William Zerby; Steven W. Miller

(57) ABSTRACT

Detergent compositions contain sticky particles with at least 45% by weight of a sticky surfactant and non-sticky particles with less than about 1% by weight of sticky surfactant. The particles are further characterized by their size ranges and bulk densities. Compositions containing potassium ions are described. Dissolution of the compositions in aqueous media is optimized.

6 Claims, No Drawings

GRANULAR COMPOSITIONS HAVING IMPROVED DISSOLUTION

FIELD OF THE INVENTION

The present invention relates to improving the dissolution of a granular detergent composition, especially in cold temperature laundering solutions (i.e., less than about 30° C.). More particularly, the detergent composition contains particles having optimally selected physical properties, such as particle size, particle density and concentration of detergent ingredients, for achieving improved dissolution performance.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. These low dosage detergents are currently in high demand as they conserve resources and can be sold in small packages which are more convenient for consumers. Unfortunately, such low dosage or "compact" detergent products experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Similarly, this clumping phenomenon can contribute to the incomplete dispensing of detergent in washing machines equipped with dispenser drawers or in other dispensing devices, such as a granulet. In this case, the undesired result is undissolved detergent residue in the dispensing device.

It has been found that the cause of the aforementioned dissolution problem is associated with the "bridging" of a "gel-like" substance between surfactant-containing particles to form undesirable "clumps." The gel-like substance responsible for the undesirable "bridging" of particles into "clumps" originates from the partial dissolution of surfactant in the aqueous laundering solutions, wherein such partial dissolution causes the formation of a highly viscous surfactant phase or paste which binds or otherwise "bridges" other surfactant-containing particles together into "clumps." This undesirable dissolution phenomena is commonly referred to as "lump-gel" formation. In addition to the viscous surfactant "bridging" effect, inorganic salts have a tendency to hydrate which can also cause "bridging" of particles which linked together via hydration. In particular, inorganic salts hydrate with one another to form a cage structure which exhibits poor dissolution and ultimately ends up as a "clump" after the washing cycle. It would therefore be desirable to have a detergent composition which does not experience the dissolution problems identified above so as to result in improved cleaning performance.

The prior art is replete with disclosures addressing the dissolution problems associated with granular detergent compositions. For example, the prior art suggests limiting the use and manner of inorganic salts which can cause clumps via the "bridging" of hydrated salts during the laundering cycle. Specific ratios of selected inorganic salts are contemplated so as to minimize dissolution problems. Such a solution, however, constricts the formulation and process flexibility which are necessary for current commercialization of large-scale detergent products. Various other mechanisms have been suggested by the prior art, all of which involve formulation alteration, and thereby reduce formulation flexibility. As a consequence, it would therefore be desirable to have a detergent composition having improved dissolution without significantly inhibiting formulation flexibility.

Accordingly, despite the disclosures in the prior art discussed previously, it would be desirable to have a detergent composition which exhibits improved cleaning performance. Also, it would be desirable to have such a detergent composition which exhibits such improved dissolution without significantly inhibiting formulation flexibility.

SUMMARY OF THE INVENTION

The invention meets the needs above by providing a detergent composition which has improved dissolution in laundering solutions, especially in solutions kept at cold temperatures (i.e., less than about 30° C.). A combination of optimally selected physical properties of various particulate detergent ingredients in a detergent composition is used to achieve improved dissolution performance. Specifically, the detergent composition comprises from about 1% to about 50%, based on the total number of discrete particles in the composition, of substantially "sticky particles" with certain composition, size and density specifications. The substantially sticky particles contain at least about 15%, by weight of the sticky particles, of a "substantially sticky surfactant." In addition, the substantially sticky particles have a geometric mean particle diameter size of from about 300 microns to about 700 microns with a geometric standard deviation of less than about 1.8, and a bulk density of at least about 450 g/l. Additionally, the composition includes at least about 35%, based on the total number of discrete particles in the admixture composition, of substantially non-sticky particles having a geometric mean particle diameter size of from about 200 microns to about 500 microns with a geometric standard deviation of greater than about 1.2 and a bulk density of less than about 850 g/l. The substantially non-sticky particles may include inorganic fillers, builders, "substantially non-sticky surfactants" and other ingredients. Typically, the non-sticky particles will have a substantially low to nil (i.e., less than about 10% on a weight basis) concentration of sticky surfactants. The total amount of surfactants, including both sticky and non-sticky surfactants, in the composition is at least about 15% by weight of the composition.

With the aforementioned optimally selected particulate concentrations, respective particle densities, particle sizes and particle size ranges as measured by geometric mean and geometric standard deviation statistics, the composition unexpectedly exhibits superior dispersion and dissolution in cold temperature laundering solutions. A method of laundering clothes comprising the steps of contacting soiled clothes with an effective amount of a detergent composition according to compositions described herein in an aqueous washing solution is also provided.

DETAILED DESCRIPTION OF THE PREFERRED EMBODIMENTS

The invention provides a detergent composition which exhibits improved dispersion and dissolution in aqueous laundering solutions. It has been found that by optimally selecting physical properties of various particles contained in granular detergent compositions, the dissolution can be improved. As mentioned previously, typical detergent formulations that dissolve in aqueous laundering solutions form highly viscous surfactant phase or paste which binds or otherwise "bridges" other surfactant-containing particles together into "clumps" ultimately causing "lump-gel" formation.

As used herein, the phrase "discrete particles" means individual particles, agglomerates or granules which can be identified via a scanning electron microscope as discrete units of mass. For each type of particle component in an admixture, the discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions.

As used herein, the phrase "geometric mean particle diameter" means the geometric mass average diameter of a set of discrete particles as measured by any standard mass-based particle size measurement technique, such as dry sieving. As used herein, the phrase "geometric standard deviation" of a particle size distribution means the geometric breadth of the best-fitted log-normal function to the above-mentioned particle size data.

As used herein, the phrase "builder" means any inorganic material having "builder" performance in the detergency context, and specifically, organic or inorganic material capable of removing water hardness from washing solutions. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel. As used herein, the term "substantially sticky surfactants" refers to a surfactant or surfactant blend system consisting primarily of surfactants which substantially contribute lump-gel formation in cold temperature washing solutions, including the general classes of alkyl benzene sulfonates, alkyl ethoxy sulfates, and nonionic surfactants. As used herein, the phrase "substantially non-sticky surfactant" refers to a surfactant or surfactant blend system consisting primarily of surfactants which do not substantially contribute to lump-gel formation in cold temperature washing solutions, such as linear-chain alkyl sulfates with an average alkyl carbon chain length of at least 12. As used herein, all specifications of level of composition and size distribution are done on a mass basis unless otherwise specified. In cases where level is specified on a number basis, the calculations used to convert from a mass to number basis are contained in Example III set forth hereinafter.

It has been found that "lump-gel formation" can be avoided by minimizing the "bridging" effect or contact points between particles which tend to be "sticky" such as particles containing surfactant systems consisting primarily of substantially sticky surfactants. This is achieved by the present invention by formulating the detergent composition with selectively decreased levels of surfactant-containing particles, wherein the "level" is based on the total "number fraction" of discrete particles in the composition. Also, the particle size and its distribution breadth (i.e. range of distribution) of the substantially sticky particles are optimally selected. Further elimination of the "bridging" effect which causes undesirable dissolution problems are achieved by increasing the level of other particulate components which typically are not "sticky", and therefore, do not lend themselves easily to "bridging" particles together into clumps or lump-gel formation. Again, the level of the non-sticky particles is based on the total number of discrete particles in the detergent composition. The physical properties, such as particle size and distribution and density, of the substantially non-sticky particles are also optimally selected. It should be understood that the "discrete particles" which contain surfactants or other ingredients such as inorganic builders can be in the form of admixed particles, spray-dried granules, and/or agglomerates, depending upon the desired overall formulation and product density.

While not intending to be bound by theory, it is believed that by selecting relatively large and relatively high density substantially sticky particles with moderate to high levels of surfactant in each discrete particle in combination with relatively small substantially non-sticky particles, the "bridging" effect can be greatly reduced in that there are relatively few (or at least fewer) contact points between so-called "sticky" surfactant-containing particles. This, in turn, reduces lump-gel formation resulting in improved dispersion and dissolution of the detergent composition in aqueous laundering solutions, especially in solutions at low temperatures. It should be understood, however, that the physical properties of the detergent composition should be maintained within reasonable limits so as to assure that typical detergent composition product attributes are maintained. For example, although a larger size of a sticky particle may help promote better dispersion, the particle size of the sticky particles should not be extremely large such that they require an inordinate amount of time before which they dissolve in the aqueous laundering solution. Similarly, the particle size of the substantially non-sticky particles should not be extremely small and have a very low density such that the detergent composition is extremely "dusty". Finally, the balance between the larger substantially sticky particles and the smaller substantially non-sticky particles should be selected so as to avoid significant product segregation in the detergent product box prior to use. As stated previously, the present invention provides an optimal selection of the various physical properties to provide the desired improved dissolution performance improvement.

To that end, the mass-based geometric mean particle size diameter of the substantially sticky particles is preferably of from about 300 microns to about 700 microns with a geometric standard deviation of less than about 1.8, more preferably of from about 350 microns to about 650 microns with a geometric standard deviation of less than about 1.7, and most preferably about 400 microns to about 600 microns with a geometric standard deviation of less than about 1.6. Preferred compositions include substantially sticky particles having at least about 15%, more preferably from about at least about 35%, and most preferably at least about 45%, by weight of the sticky particles, of a substantially sticky surfactant. Although a wide variety of sticky surfactants are suitable for use in the detergent compositions of the invention, an especially preferred substantially sticky surfactant is a potassium salt of a surfactant selected from the group consisting of linear alkyl benzenes, alkyl ethoxy sulfates, and mixtures thereof. The average bulk density of the substantially sticky particles is preferably at least about 450 g/l, more preferably at least about 550 g/l, and most preferably at least about 650 g/l.

Preferably, the geometric mean particle size diameter of the substantially non-sticky particles is preferably of from about 200 microns to about 500 microns with a geometric standard deviation of greater than about 1.2, more preferably of from about 250 microns to about 450 microns with a geometric standard deviation of greater than about 1.4, more preferably of from about 300 microns to about 400 microns with a geometric standard deviation of greater than about 1.6. Preferred compositions include inorganic builder-containing particles having less than about 10%, more preferably less than about 5%, and most preferably less than about 1%, by weight of the non-sticky particles, of a substantially sticky surfactant. The average bulk density of the non-sticky particles is preferably less than about 850 g/l, more preferably less than about 650 g/l, and most preferably less than about 500 g/l.

Although a wide variety of inorganic builders are suitable for use in the substantially non-sticky particles of the invention, especially preferred non-sticky particles comprise sodium or potassium salts selected from the group consisting of sodium chloride, sodium carbonate, sodium sulfate, tetrasodium pyrophosphate, trisodium pyrophosphate, disodium pyrophosphate, monosodium pyrophosphate, potassium chloride, potassium carbonate, potassium sulfate, tetrapotassium pyrophosphate, tripotassium pyrophosphate, dipotassium pyrophosphate, monopotassium pyrophosphate and mixtures thereof. Additional dissolution enhancements are achieved when the composition comprises from about 0.05% to about 50% by weight of potassium preferably from about 0.5% to about 30%, more preferably from about 1% to about 20%, by weight, of potassium ions, regardless of the source from which the potassium ions derive. Typically, however, potassium ions useful herein are derived from potassium salts. Some of non-limiting examples of the potassium salts useful herein are potassium salts of alkali builders (e.g. potassium salt of carbonates, potassium salt of silicates), potassium salt of mid-chain branched surfactants, and mixtures thereof.

Of the potassium salts, inorganic potassium salts are preferred, and are more preferably selected from the group consisting of potassium chloride (KCl), potassium carbonate ($K_2CO_3$), potassium sulfate ($K_2SO_4$), and mixtures thereof. These are commercially available. Potassium carbonate is most preferred. Inorganic potassium salts may include dehydrated (preferably) or hydrated tetrapotassium pyrophosphate ($K_4P_2O_7$; preferred), tripotassium pyrophosphate ($HK_3P_2O_7$ ), dipotassium pyrophosphate ($H_2K_2P_2O_7$), and monopotassium pyrophosphate ($H_3KP_2O_7$). Of the hydrates, those which are stable up to about 120° F. (48.9° C.) are preferred. Other potassium salts for use herein are dehydrated (preferably) or hydrated pentapotassium tripolyphosphate ($K_5P_3$ $O_{10}$) tetrapotassium tripolyphosphate ($K_5P_3O_{10}$), tetrapotassium tripolyphosphate ($HK_4P_3O_{10}$), tripotassium tripolyphosphate ($H_2K_3P_3O_{10}$ ), dipotassium tripolyphosphate ($H_3K_2P_3O_{10}$), and monopotassium tripolyphosphate ($H_4KP_3O_{10}$); potassium hydroxide (KOH); potassium silicate; and potassium neutralized surfactant such as potassium longer alkyl chain, mid chain-branched surfactant compounds, liner potassium alkylbenzene sulfonate, potassium alkyl sulfate, and/or potassium alkylpolyethoxylate.

Also suitable for use herein are salts of film forming polymers as described in U.S. Pat. No. 4,379,080, Murphy, issued Apr. 5, 1983, column 8, line 44 to column 10, line 37, incorporated herein, which are either partially or wholly neutralized with potassium. Particularly preferred are the potassium salts of copolymers of acrylamide and acrylate having a molecular weight between about 4,000 and 20,000. In addition, the combination of both types of the aforementioned particles must net an overall particle size distribution that has less than about 5% fine and less than about 5% oversize particles, where the fine limit is defined at 150 microns and the oversize limit is defined at 1180 microns.

Sticky Detersive Surfactants

Nonlimiting examples of the preferred substantially sticky surfactants include anionic surfactants which include the conventional $C_{11}$–$C_{18}$ alkyl benzene sulfonates, branched-chain and random $C_{10}$–$C_{20}$ alkyl sulfates, the $C_{10}$–$C_{18}$ secondary (2,3) alkyl sulfates of the formula $CH_3(CH_2)x(CHOSO_3^-M^+)CH_3$ and $CH_3(CH_2)y(CHOSO_3^{-M+})CH_2CH_3$ where x and (y+1) are integers of at least about 7, preferably at least about 9, and M is a water-solubilizing cation, especially sodium or potassium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful include and $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Inorganic Builders

A variety inorganic builders are suitable for use herein and include aluminosilicates, crystalline layered silicates, MAP zeolites, citrates, amorphous silicates, sodium carbonates and mixtures thereof. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Patent No. 4,605,509, previously incorporated herein by reference.

Adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference. Water-soluble, nonphosphorus organic builders useful herein include the various alkali metal, armmonium and substituted ammoniurn polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,78 1 Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued August 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLES I–II

The following Examples illustrate detergent compositions within the scope of the invention as well as a Control example to illustrate a composition outside the scope of the invention. The specific detergent ingredients and relative proportions are shown below, wherein "LAS" means $C_{12-14}$ linear alkylbenzene sulfonate surfactant, "AS" means $C_{14-15}$ alkyl sulfate surfactant, "AES" means $C_{14-15}$ alkyl ethoxy (EO=3) sulfate surfactant, and "65/25/10" is a percentage weight ratio:

| | Control Weight % | I Weight % | II Weight % |
|---|---|---|---|
| Spray-dried granules TOTAL | 49.41 | 36.45 | 46.07 |
| 65/25/10 LAS:AS:AES | 9.95 | 0.00 | 0.00 |
| Aluminosilicate, Na | 14.06 | 14.25 | 22.09 |
| Sodium carbonate | 11.86 | 13.81 | 14.27 |
| Sodium silicate | 0.58 | 0.58 | 0.58 |
| Polyacrylate | 2.26 | 2.26 | 2.26 |
| Polyethylene glycol MW = 4000 | 1.01 | 1.26 | 0.51 |
| Brightener | 0.17 | 0.17 | 0.17 |
| Sodium sulfate | 5.46 | 0.00 | 0.00 |
| Moisture | 3.73 | 3.78 | 5.85 |
| Agglomerates TOTAL | 38.99 | 54.13 | 38.99 |
| 65/25/10 LAS:AS:AES | 11.70 | 21.65 | 21.65 |
| Aluminosilicate, Na | 13.72 | 13.53 | 5.69 |
| Sodium carbonate | 8.11 | 13.53 | 5.69 |
| Sodium sulfate | 0.00 | 2.37 | 0.00 |
| Polyethylene glycol MW = 4000 | 0.58 | 0.32 | 1.08 |
| Moisture | 4.87 | 2.71 | 4.87 |
| Admixed components | | | |
| Sodium carbonate | 7.37 | 0.00 | 7.37 |
| Sodium perborate | 1.03 | 1.03 | 1.03 |
| Cellulase enzyme | 0.33 | 0.33 | 0.33 |
| Protease enzyme | 0.13 | 0.13 | 0.13 |
| Perfume | 0.42 | 0.42 | 0.42 |
| Misc and moisture | --balance-- | --balance-- | --balance-- |

The spray-dried granules are prepared using a standard spray drying process in which the ingredients are mixed together to form a slurry which is then sprayed into a spray drying tower to form spray dried granules. The detergent agglomerates are prepared by combining the surfactant paste and other ingredients together in one or more mixers until detergent agglomerates are formed. The admixed components are simply added to the granules and agglomerates if it a dry ingredient and sprayed on if in liquid form. The various physical properties of the compositions are shown below:

| Physical Properties | Control | I | II |
|---|---|---|---|
| Spray dried granules | | | |
| Total sticky surfactant level (wt. %) | 19.9 | 0 | 0 |
| Mean particle diameter (microns) | 250 | 350 | 350 |
| Particle size standard deviation | 1.5 | 1.5 | 1.5 |
| Bulk density (g/l) | 400 | 450 | 450 |
| Agglomerates/Admixes | | | |
| Mean particle diameter (microns) | 400 | 400 | 400 |
| Particle size standard deviation | 1.7 | 1.7 | 1.7 |
| Bulk density (g/l) | 850 | 700 | 670 |

The Control composition is a typical detergent composition having about 90% of substantially sticky particles (spray dried granules plus agglomerates) based on the total number of particles in the composition. As a result, the Control composition has a high number of sticky particle contact points which renders it susceptible to "bridging" effects ultimately causing lump-gel formation. By contrast, the Example I and II compositions only contain sticky surfactants in the higher-density agglomerates, and therefore, have about 30% or fewer sticky particles, based on the total number of particles in the composition. Unexpectedly, Examples I and II have a much better ROOA ("Reverse Order Of Addition") grade and experience less residual mass in the washing machine and on the clothes subsequent to standard laundering operations.

EXAMPLE III

Calculation of Particle Number Percentages Based on the Total number of Discrete Particles in a Detergent Composition This Example illustrates one of the many means by which the particle number percentage of sticky particles and/or non-sticky particles can be determined relative to the total number of discrete particles in the composition. The input variables describe the physical characteristics of each admixture component within the mixture:

$w_i$ weight of component i in the composition;

$d_i$ geometric mean particle size on a mass basis;[1]

$\sigma_i$ geometric standard deviation of the particle size distribution on a mass basis;

$\rho_i$ bulk density.

In order to quantify the potential for bridging between particles, we want to consider the number distribution of particles in the admixture. On the other hand, it is recognized that virtually all bulk powder manufacturing operations operate on the basis of mass. Therefore, it is desired to use the mass fractions of particulate components as the basis for defining the admixture, and convert from mass to number basis.

First, the weight fraction of each mixture component, $w_i$, is converted to the total mixture volume fraction, $V_i$. This is done using an intermediate volume, $v_i$, and the component bulk density, $\rho_i$ (eq. A1). The component volumes are normalized to total mixture volume fractions (eq. A2).

$$v_i = \frac{w_i}{\rho_i};\ \text{conversion of weight to volume} \tag{A1}$$

$$V_i = \frac{v_i}{\sum_k v_k};\ \text{volume fraction of component } i \text{ in mixture} \tag{A2}$$

A numerical method is used to convert the massed-based distribution to a number basis. For each component (i), consider a range of n size class values (j), $x_{ij}$, where:

$$\log(x_{il}) = \log(d_i) - 3\times\log(\sigma_i);\ \text{fines limit} \tag{A3}$$

$$\log(x_{in}) = \log(d_i) + 3\times\log(\sigma_i);\ \text{coarse limit} \tag{A4}$$

and the intermediate values (j=2 to n−1) are distributed at equal intervals of $\Delta\log(x)$, where $\Delta\log(x)=[\log(x_{in})-\log(x_{il})]/30$. The log-normal distribution describes a differential mass fraction per log(size), $y_{ij}$, as follows (eq. A5).

$$y_{ij} = \frac{1}{2\pi\log(\sigma_i)} \times \exp\left(\frac{-(\log(x_{ij}) - (\log(d_i))^2}{2\times(\log(\sigma_i))^2}\right);\ \text{log normal distrubution function} \tag{A5}$$

Converting from mass to number population, we calculate a population, $z_{ij}$, of particles (i) associated with each discrete mass fraction (eq. A6), and a normalized population, $Z_{ij}$, (eq. A7).

$$z_{ij} = \left(\frac{6}{\pi}\right) y_{ij} \cdot (x_{ij})^{-3}; \text{ population of particle } i \text{ in size class } j \quad \text{(A6)}$$

The number density, $n_i$, of component i particles is defined as the population of component (i) particles per unit volume of mixture; this is the product of the volume fraction and the sum of the (i) populations over all size classes, j (eq. A7). The number fraction, $N_i$, of each component is calculated by normalizing the number population over all components in the mixture (eq. A8). The number percent is simply the number fraction times 100.

$$n_i = V_i \cdot \sum_j z_{ij}; \text{ number density, or population of particle } i \text{ per unit volume of mixture, summed over all size classes, } j \quad \text{(A7)}$$

$$N_i = \frac{n_i}{\sum_k n_k}; \text{ number fraction of component } i \text{ particles in the full admixture} \quad \text{(A8)}$$

Having thus described the invention in detail, it will be obvious to those skilled in the art that various changes may be made without departing from the scope of the invention and the invention is not to be considered limited to what is described in the specification.

What is claimed is:

1. A detergent composition comprising:

(a) from about 1% to about 50%, based on the total number of discrete particles in said composition, of substantially sticky particles containing at least about 45% by weight of said sticky particles, of a substantially sticky surfactant, wherein said sticky particles have a geometric mean particle diameter size of from about 300 microns to about 700 microns with a geometric standard deviation of less than about 1.8, and a bulk density at least about 450 g/l; and (b) greater than about 35%, based on the total number of discrete particles in said composition, of substantially non-sticky particles having a geometric mean particle diameter size of from about 200 microns to about 500 microns with a geometric standard deviation of greater than about 1.2 and a bulk density of less than about 850 g/l; said non-sticky particles containing less than about 1% by weight of a sticky surfactant and wherein the total amount of detersive surfactant in said composition is at least about 15% by weight of said composition.

2. The detergent composition of claim 1 wherein the bulk density of said sticky particles is at least about 550 g/l and the bulk density of said non-sticky particles is less than about 650 g/l.

3. The detergent composition of claim 1 wherein the bulk density of said sticky particles is at least about 650 g/l and the bulk density of said non-sticky particles is less than about 500 g/l.

4. The detergent composition of claim 1 wherein said sticky particles have a geometric mean particle diameter size of from about 350 microns to about 650 microns with a geometric standard deviation of less than about 1.7.

5. The detergent composition of claim 1 wherein said non-sticky particles have a geometric mean particle diameter size of from about 250 microns to about 450 microns with a geometric standard deviation of greater than about 1.4.

6. A method of laundering clothes comprising the steps of contacting said clothes with an effective amount of a detergent composition according to claim 1 in an aqueous washing solution.

* * * * *